US005760686A

United States Patent [19]

Toman

[11] Patent Number: 5,760,686

[45] Date of Patent: Jun. 2, 1998

[54] ASSEMBLY AND METHOD FOR DETECTING ERRANT VEHICLES AND WARNING WORK ZONE PERSONNEL THEREOF

[76] Inventor: John R. Toman, 121 Corral Ter., Ballwin, Mo. 63011

[21] Appl. No.: 711,393

[22] Filed: Sep. 3, 1996

Related U.S. Application Data

[63] Continuation-in-part of Ser. No. 194,931, Feb. 14, 1994, Pat. No. 5,552,767.

[51] Int. Cl.[6] ..... G08B 21/00

[52] U.S. Cl. ..... 340/540; 340/552; 340/908; 340/908.1; 340/331; 340/907

[58] Field of Search ..... 340/540, 552, 340/556, 555, 908, 908.1, 331, 691, 693, 557, 553, 907, 936

[56] References Cited

U.S. PATENT DOCUMENTS

| | | | |
|---|---|---|---|
| 3,060,406 | 10/1962 | Wright | 340/908 |
| 3,660,817 | 5/1972 | Abrams | 340/908 |
| 3,711,846 | 1/1973 | Schlisser et al. | 340/552 |
| 3,906,492 | 9/1975 | Narbaits-Jaureguy | 340/552 |
| 4,103,298 | 7/1978 | Redding | 340/331 |
| 4,132,983 | 1/1979 | Shapiro | 340/331 |
| 4,203,091 | 5/1980 | Kruskopf | 340/331 |
| 4,599,121 | 7/1986 | Edwards et al. | 156/48 |
| 4,841,278 | 6/1989 | Tezuka et al. | 340/908.1 |
| 5,132,659 | 7/1992 | Kuo | 340/326 |
| 5,231,393 | 7/1993 | Strickland | 340/936 |
| 5,233,185 | 8/1993 | Whitaker | 250/222.1 |
| 5,302,942 | 4/1994 | Blau | 340/556 |
| 5,552,767 | 9/1996 | Toman | 340/540 |
| 5,602,522 | 2/1997 | Pacelli | 340/331 |

*Primary Examiner*—Jeffery Hofsass
*Assistant Examiner*—Benjamin C. Lee
*Attorney, Agent, or Firm*—Howell & Haferkamp, L.C.

[57] ABSTRACT

An apparatus and method are disclosed for detecting and signaling when a vehicle enters or poses a serious risk of entering a roadway work zone. The apparatus comprises an intrusion detector array for detecting a vehicle breaching the work zone perimeter, and a high intensity strobe light array for providing an optical warning signal when the perimeter breaching vehicle is detected. The detector array includes one or more transmitters for emitting pulsed infrared signals along the work zone perimeter, and one or more receivers for detecting the presence or absence of the pulsed infrared signals, where the receivers include filters for removing stray signals emanating from sources other than the transmitters. The strobe light array includes a primary strobe activated by the detector array when a perimeter breaching vehicle is detected, and several relay strobes which are activated by the optical warning signal emitted by the primary strobe or another relay strobe. The primary and relay strobes emit a high intensity, psychologically proactive optical warning signal that is capable of immediate perception by work zone personnel despite the presence of noise and distractions. The detector array may also include a pneumatic hose assembly, and the assembly may include an electromagnetic emitter for falsely conveying the presence of a police radar trap. The electromagnetic emitter may be embodied in an excessive speed module for detecting a vehicle approaching the work zone at an excessive speed, and for activating the strobe light array upon detecting the speeding vehicle.

12 Claims, 4 Drawing Sheets

ASSEMBLY AND METHOD FOR DETECTING ERRANT VEHICLES AND WARNING WORK ZONE PERSONNEL THEREOF

CROSS-REFERENCE TO RELATED APPLICATION

This is a continuation-in-part of application Ser. No. 08/194,931 filed Feb. 14, 1994, now U.S. Pat. No. 5,552,767, the disclosure of which is incorporated herein by reference.

BACKGROUND OF THE INVENTION (1) Field of the Invention

This invention relates to an assembly and method for detecting when a vehicle enters or poses a serious risk of entering a roadway work zone, and for warning personnel within the work zone of the errant vehicle. More particularly, this invention relates to an assembly and method for detecting errant vehicles using pulsed infrared detectors and/or excessive speed detectors, and for warning personnel within the work zone of the errant vehicles with high intensity strobe lights.

(2) Description of the Related Art

Traffic accidents on a given section of a roadway greatly increase while road work is performed in or near the roadway section. Lane restrictions, traffic speed fluctuations, narrow lanes and/or bi-directional traffic flow, vehicles entering and exiting the roadway, equipment noise, and the generally distracting surroundings of a work zone contribute to the propensity of accidents in and around roadway work zones. This propensity for accidents poses a grave risk to road construction crews, utility crews, maintenance workers, and other personnel in the vicinity of the work zone, and poses an even graver risk to those personnel that are not at least somewhat protected within a vehicle or by a large piece of machinery. It is not uncommon for accident rates to increase fifty percent or more during times of construction, and these accidents are increasingly causing injury and death to work zone personnel. Along with the human tragedy of the increased work zone related injuries and deaths, contractors suffer economically as well from workers' compensation rate increases, increased tort liability, and decreases in worker productivity and morale as work zone personnel pay greater attention to oncoming traffic and less attention to their work assignments.

Various devices and techniques are known which attempt to alert drivers to approaching roadway hazards. These devices were designed to make drivers more aware of their surroundings and reduce the speed of their vehicles as they approach roadway hazards. The prior art devices and techniques include: regulatory and advisory signage, dynamic speed limit signage, mock-up police cars, high visibility clothing for work zone personnel, rotating and flashing incandescent or LED warning lights, and traffic flow diversion devices, to name but a few. While these prior art devices and techniques undoubtedly deterred countless additional work zone related accidents, those devices are directed solely at alerting drivers of an approaching hazard. The devices had no way to warn work zone personnel if or when a vehicle strayed from a designated traffic lane and breached the work zone perimeter.

Therefore, a device was developed with the intent of alerting work zone personnel when a vehicle enters the work zone. However, the harsh environment of the roadway work zone proved too large an obstacle for this device to effectively warn workers. The device included a detector that employed either a continuous infrared signal or an ultrasonic beam to detect a vehicle passing thereby. The infrared signal or ultrasonic beam was positioned "upstream" from the work zone and was oriented at ninety degrees to the oncoming traffic. This detector communicated via a wireless data link to a 120 decibel siren positioned within the work zone. When a vehicle was detected upstream, a signal was transmitted to the siren for sounding an audible warning. Another embodiment of this device used a pneumatic hose laid across the roadway in place of the infrared signal or ultrasonic beam.

The problems with this warning device were numerous. Perhaps the most significant of which was attributable to the near deafening noise levels present in many roadway work zones. In addition to the traffic and wind noise along any stretch of roadway, many work zones use heavy construction machinery including jackhammers, shot blasters, and concrete cutters which create a tremendous amount of noise. Because the Occupational Safety and Health Administration ("OSHA") standards require operators of such machinery to wear hearing protection, the operators were unable to hear the audible warning of the 120 decibel siren over the noise of the equipment they were operating and through their hearing protection. In fact, even without hearing protection, personnel in the vicinity of this machinery and equipment often did not hear the audible warning. Thus, this prior art device had the effect of luring personnel into a false sense of security due to its presence, even though the performance of the alarm was unsuited to its operating environment.

This prior art warning device also suffered from several integrity problems. Because the device used a single detector positioned upstream from the work zone with the detection beam oriented perpendicular to approaching traffic, vehicles would sometimes enter the work zone downstream from the device without tripping the detector. In addition, the heat and audible noise produced by work zone equipment, passing traffic, and other conditions of the work zone environment were capable of interfering with the infrared or ultrasonic detector in such a way that the detector could fail to detect a vehicle passing through the detection beam. Because the detector was designed to sense the presence or absence of a reflected detection beam, the detector was susceptible to detecting the heat or noise produced in the work zone as the reflected detection beam, even when the detection beam was obstructed by a vehicle entering the work zone. This was particularly true where the detector employed a continuous infrared signal, as it was difficult to distinguish the continuous infrared signal from ambient infrared energy. Thus, the potential always existed for a vehicle to pass through the detection beam without sounding the alarm, and without any warning to the work zone personnel.

Additionally, airborne particulate matter, birds, precipitation, and drifting debris could sporadically interrupt the constant signal or beam transmitted by the detector, thereby causing false detections which resulted in a loss of credibility for the device and costly work stoppages. Further still, the distance between the detector and the siren necessitated a wireless data link therebetween (which itself required FCC approval). Modern work zones are flooded with electromagnetic noise within the popular communication frequencies. The frequent use of walkie-talkies by work zone personnel, portable and cellular telephones by work zone personnel and passing traffic, and CB and short wave radios by passing vehicular and air traffic oftentimes triggered the siren, again causing a significant problem with false alarms.

Another device is known in the prior art which was intended to alert work zone personnel when a vehicle entered the work zone, and which overcame one of the many problems of the earlier device discussed above. While the earlier device employed a single detection beam that was positioned upstream from the work zone and oriented perpendicular to oncoming traffic, the latter device was configured to detect the intrusion of a vehicle into the work zone along any section of the work zone perimeter adjacent to an active traffic lane. An infrared source was placed at the beginning of the work zone which transmitted a continuous wave infrared signal along the perimeter of the work zone for reception by an infrared detector positioned downstream. If a vehicle passed between the source and the detector, thereby interrupting the continuous wave infrared signal transmitted therebetween, the detector would acknowledge this obstruction by sounding an alarm. However, this device also suffered numerous problems in operation.

First, because a continuous wave infrared signal was employed, filters could not be used in the receiver to remove low frequency infrared noise without also removing the infrared signal to be detected. Nor could filters be used in the receiver electronics to remove electromagnetic noise emanating from sources within or proximate to the work zone. The range of the device was therefore unduly limited, as the detector could not be placed more than approximately 750 feet from the infrared source and still reliably distinguish the continuous infrared signal from other infrared energy present in the work zone. Given that typical roadway work zones have a length well in excess of 750 feet, an unacceptably large number of infrared sources and detectors had to be used in order to detect breaching vehicles along the entire perimeter of the work zone adjacent to active traffic lanes. Moreover, because the infrared source had to transmit a focused and narrow beam in order to have a detectable range of 750 feet, the infrared detector had to be precisely positioned in the line of sight of the infrared source to receive the transmitted beam. The infrared detector was therefore difficult to set up and align along the work zone perimeter, and was not amenable to being moved frequently from work zone to work zone. This lack of portability was further amplified where numerous infrared sources and detectors had to be employed. The infrared detector could also be fooled into detecting a stray infrared signal as the constant infrared beam so that a vehicle could pass into the work zone undetected. Further still, this device, like all other prior art devices, employed an audible alarm for signalling personnel of an errant vehicle, the significant drawbacks of which were described above.

All prior art devices intended for alerting work zone personnel to vehicles breaching the work zone perimeter relied on audible alarms, despite the high level of noise which pervades the work zones, and despite OSHA regulations relating to hearing protection which substantially degrade the effectiveness of audible alarms. Although several of the devices which alert drivers, rather than personnel, to approaching roadway hazards employ a variety of rotating and/or flashing lights to attract the drivers' attention, such lights have never been used to convey information to the work zone personnel. This is perhaps for two reasons. First, most believe that by working in a roadway work zone where numerous flashing signs and rotating lights are present for alerting drivers to the presence of the work zone, the work zone personnel have become immune to optical warning signals, and cannot readily distinguish a typical warning light for alerting drivers from a warning light for alerting the personnel of a hazard. Second, because the attention of the work zone personnel is supposed to be on the task they are paid to perform, one cannot realistically expect the worker to be looking in the direction of a warning light at all times for quickly perceiving a warning signal. For example, if a typical rotating incandescent light was used to convey the intrusion of a vehicle into the work zone, it is highly probable that a worker operating a jack hammer would be looking down and away from the light while performing this task, and thus would not perceive the warning signal at all, or at least not within sufficient time to evacuate the work zone or otherwise evade the approaching vehicle.

What is needed is an assembly and method for reliably detecting errant vehicles along any section of the work zone perimeter, and for contemporaneously warning work zone personnel thereof. The assembly must be easy to set up so it can be frequently moved from one work zone to another, and the type of warning signal employed needs to be capable of immediate perception by the personnel irrespective of the noise levels and distractions within the work zone. Such a detection and warning system should also be capable of reliable operation without interference by the heat and noise produced in the work zone, and should have a negligible chance of false alarms, or "falsing," so as to develop credibility with the personnel and avoid costly work stoppages. Further still, such a system is needed that has the additional capability of detecting vehicles which have a high probability of entering the work zone, even before the vehicles breach the work zone perimeter or leave their designated traffic lanes.

SUMMARY OF THE INVENTION

The inventor hereof has succeeded at solving these and other needs by designing and developing an assembly and method for detecting and signaling when a vehicle enters, or poses a serious risk of entering, a roadway work zone. In one embodiment, the assembly comprises a portable intrusion detector array for detecting a vehicle as it enters the work zone along a section of the work zone perimeter, and a portable, high intensity strobe light array for signaling the presence of the errant vehicle. The intrusion detector array and the high intensity strobe light array are both easily set up within the work zone environment, and are capable of reliably detecting and signalling the presence of a perimeter breaching vehicle without interference by the harsh conditions of the work zone environment. The assembly is virtually immune to falsing, and provides a high intensity optical warning signal that is capable of immediate perception by the work zone personnel when a perimeter breaching vehicle is detected.

The high intensity strobe light array includes a primary strobe which emits a white, omnidirectional, optical warning signal at a predetermined flash rate when an errant vehicle is detected, as well as several relay strobes which emit a white, omnidirectional, optical warning signal substantially identical to that of the primary strobe. The relay strobes include illuminators for emitting the optical warning signal, and photosensors for detecting an infrared component of the optical warning signal emitted by the primary strobe, or by another relay strobe, and for activating the illuminators upon detecting the infrared component. The flash rate of the optical warning signal is at least fifteen times per second, which is a psychologically proactive flash rate capable of immediate perception by work zone personnel despite the high level of noise and distractions present within the work zone. The flash rate is preferably 21.973 Hz, as the inventor hereof has determined that neither natural nor man-made light sources emit infrared signals at this frequency which could otherwise falsely activate the relay strobes. As further protection against falsing, the photosensors have a flash recognition setting of six flashes, which means the illuminators are not activated until the photosensors detect six or more flashes of the optical warning signal emitted by the primary strobe or another relay strobe.

The intensity of the optical warning signal emitted by the primary and relay strobes is such that reflections of the warning signal can be readily perceived. Thus, personnel need not be looking directly at one of the strobes to perceive the optical warning signal, but can instead focus on the task they are paid to perform with the comfort of knowing that reflections of the optical warning signal will quickly attract their attention when an errant vehicle is detected. In the preferred embodiment, the intensity of the optical warning signal is approximately 1200 candela effective.

The intrusion detector array employs a master transmitter for emitting an intrusion detection signal, a master receiver for detecting the presence or absence of the intrusion detection signal, and possibly one or more repeaters for relaying the intrusion detection signal from the master transmitter to the master receiver. Each repeater, also referred to as an intermediate receiver-transmitter pair, includes an intermediate receiver for detecting the presence or absence of an intrusion detection signal emitted by a remote, upstream transmitter, and an intermediate transmitter for emitting a substantially identical intrusion detection signal to a remote, downstream receiver. Upon failing to detect the intrusion detection signal emitted by the remote, upstream transmitter, the intermediate receiver disables the intermediate transmitter. As a result, the master receiver will fail to detect the intrusion detection signal, and will activate the primary strobe which, in turn, activates the relay strobes so as to saturate the work zone with the high intensity optical warning signal.

The employed intrusion detection signal is preferably a pulsed infrared signal which overcomes the integrity problems of the prior art by having a frequency of approximately 500 kHz. Because nearly all of the stray infrared signals present within a work zone have a frequency well below 500 kHz, the receivers of the intrusion detector array each include bandpass filters for removing these stray infrared components, as well as infrared signals having frequencies greater than the intrusion detection signal, while permitting detection of the 500 kHz intrusion detection signal. Because filters are employed, the receivers can readily detect the pulsed infrared signal without having to distinguish this signal from stray signals. Therefore, greater divergence of the pulsed infrared signal can be tolerated, resulting in a detection signal that has a large cross-sectional area by the time it travels to a downstream receiver, thereby facilitating alignment of the downstream receiver with the source of the detection signal. The receivers also include bar graph displays to further facilitate the alignment process.

In addition, the receivers are configured to ignore insignificant interruptions in the intrusion detection signal which occasionally result from birds, drifting debris, etc. The receivers only disable an intermediate transmitter, or activate the primary strobe, upon failing to detect the intrusion detection signal for more than a predetermined period of time which, in the preferred embodiment, is approximately one-tenth of a second. The receivers also include visual displays to further facilitate the alignment process.

In various embodiments of the present invention, the intrusion detector array includes a pneumatic hose assembly positioned along a section of the work zone perimeter, possible to reduce the number of intermediate receiver-transmitter pairs needed for a particular application. The assembly may also include an electromagnetic emitter for radiating vehicles approaching the work zone with electromagnetic energy so as to falsely convey the presence of a police radar trap to drivers having onboard radar detectors, which typically results in a voluntary and rapid reduction in the speed of approaching vehicles. The electromagnetic emitter can be randomly activated to prevent drivers from recognizing the work zone as the source of the electromagnetic energy.

The inventor hereof has also recognized that vehicles approaching the work zone at dangerously high speeds pose the gravest risk to work zone personnel, and have the highest probability of breaching the work zone perimeter. Thus, in another embodiment of the present invention, the electromagnetic emitter is embodied within an excessive speed detector that activates the high intensity strobe light array upon detecting a vehicle approaching the work zone at a speed in excess of a preset speed threshold. In this manner, personnel within the work zone are provided with a warning signal when a vehicle is approaching the work zone at a dangerously high speed, even before the vehicle breaches the work zone perimeter or otherwise leaves its designated traffic lane. Preferably, the excessive speed module has the capability of distinguishing between vehicles approaching the detector (and hence the work zone) from those travelling away from the detector.

A method for decreasing accidents within a roadway work zone, in accordance with the present invention, comprises the steps of detecting errant vehicles, i.e., detecting a perimeter breaching vehicle and/or a vehicle traveling at an excessive speed, and activating an optical warning signal, which is preferably a high intensity primary strobe, when an errant vehicle is detected. The method also includes activating a high intensity relay strobe with the high intensity primary strobe. The detecting step preferably includes emitting a pulsed infrared signal along a section of the work zone perimeter, and/or detecting a perimeter breaching vehicle with a pneumatic hose. The method may also comprise the step of radiating vehicles approaching the work zone with electromagnetic energy to set off onboard radar detectors, either randomly or continuously.

While the principal advantages and features of the present invention have been described above, a greater understanding of the invention may be attained by referring to the drawings and the detailed description of the preferred embodiments which follow.

DETAILED DESCRIPTION OF THE PREFERRED EMBODIMENTS

Figure 1:
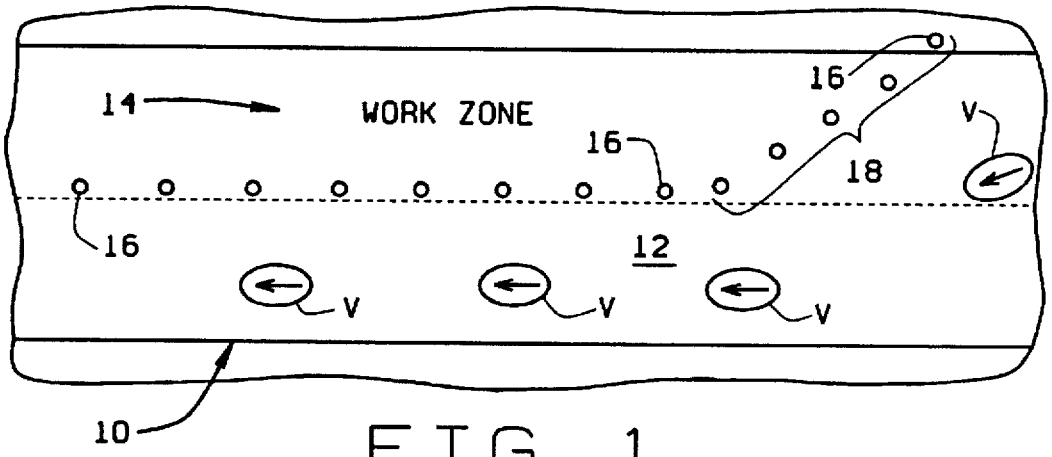
FIG. 1 is a top view of a typical roadway work zone.

A typical roadway work zone is illustrated in FIG. 1. As shown therein, a roadway 10 includes an active traffic lane 12 and a work zone 14 adjacent to the active traffic lane. The work zone 14 may include construction crews, utility crews, maintenance crews, and other personnel necessary for roadway upkeep. The active lane 12 has vehicles therein represented by an ellipse and the letter "V" with an arrow in each ellipse indicating the vehicle's direction of travel. Although each vehicle depicted in FIG. 1 is traveling in the same direction, it is not uncommon for a roadway work zone to be set up adjacent to or between active traffic lanes containing bidirectional traffic flow, and it should be understood that the assembly and method of the present invention are equally applicable to both of these environments.

A plurality of barrels 16, known in the art as channelizers, line a perimeter of the work zone 14 adjacent to the active lane 12 and function to segregate the work zone from the active lane. A taper 18, which defines the beginning of the work zone 14, is located upstream from where road work is to be performed and is formed by positioning channelizers 16 so as to gradually direct oncoming traffic into the active lane 12 and around the work zone 14. As used herein, "upstream" indicates the direction opposite the flow of traffic in the active lane 12. Thus, with reference to FIG. 1, "upstream" is to the right, while "downstream" is to the left.

Figure 2:
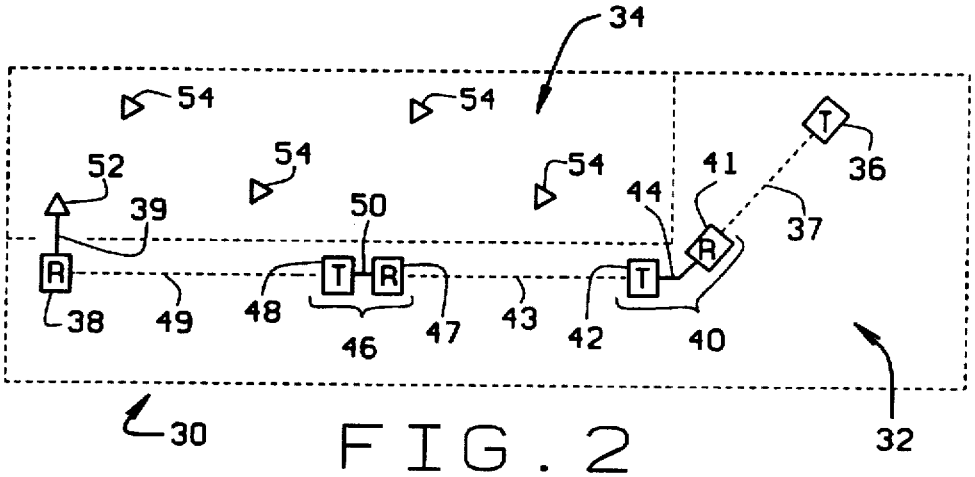
FIG. 2 is a top view of an assembly according to the present invention which comprises an intrusion detector array and a high intensity strobe light array.

An assembly constructed according to the principles of the present invention for signalling when a vehicle enters the work zone 14 is indicated generally as 30 in FIG. 2, and includes an intrusion detector array 32 and a high intensity strobe light array 34. As will be apparent, the intrusion detector array 32 is used to detect a vehicle which has strayed from an active traffic lane and breached a work zone perimeter, while the high intensity strobe light array 34 is used to provide a readily perceivable optical warning signal to warn personnel positioned within the work zone (including personnel physically inside of the work zone perimeter as well as those within a vicinity thereof) of the errant vehicle. The intrusion detector array 32 includes a master transmitter 36, a master receiver 38, and two intermediate receiver-transmitter pairs 40 and 46. The intermediate pairs 40 and 46 are used to repeat an intrusion detection signal 37, emitted by the master transmitter 36, when it is necessary to redirect the path of the detection signal 37 such as at the end of a taper or along a curved or inclined roadway, and/or when the length of the work zone perimeter along which an intrusion is to be detected exceeds the detectable range of the intrusion detection signal 37. Although two intermediate receiver-transmitter pairs 40 and 46 are shown in FIG. 2, it should be understood that more or less may be required for a particular application of the present invention.

Intermediate pair 40 includes an intermediate receiver 41 for receiving the detection signal 37 emitted by the remote master transmitter 36, and an intermediate transmitter 42 for emitting a detection signal 43 that is substantially identical to the detection signal 37. Receiver 41 outputs a control signal 44 which, when asserted, enables the transmitter 42 to emit the detection signal 43 and, when deasserted, disables the transmitter 42. Similarly, intermediate pair 46 includes an intermediate receiver 47 for receiving the detection signal 43 emitted by the remote transmitter 42, and an intermediate transmitter 48 which is enabled or disabled by the receiver 47 via a control signal 50. The transmitter 48 emits a detection signal 49, which is substantially identical to detection signals 37 and 43, when the control signal 50 is asserted. Although not shown, the master transmitter 36 also includes a gated input that, in this embodiment, is configured to enable the master transmitter 36 to continuously emit the intrusion detection signal 37.

The high intensity strobe light array 34 includes a primary strobe 52, and several relay strobes 54 that are activated by an infrared light signal having a particular frequency. The primary strobe 52 is activated when a control signal 39 output by the master receiver 38 is asserted. When activated, the primary strobe 52 emits an omnidirectional, high intensity optical warning signal at a predetermined flash rate. Each relay strobe 54 is configured to emit a flashing, omnidirectional, high intensity optical warning signal that is substantially identical to the optical warning signal emitted by the primary strobe 52, and is activated upon detecting infrared components of the optical warning signal emitted by the primary strobe 52 or by another relay strobe 54 at the predetermined flash rate.

Figure 3:
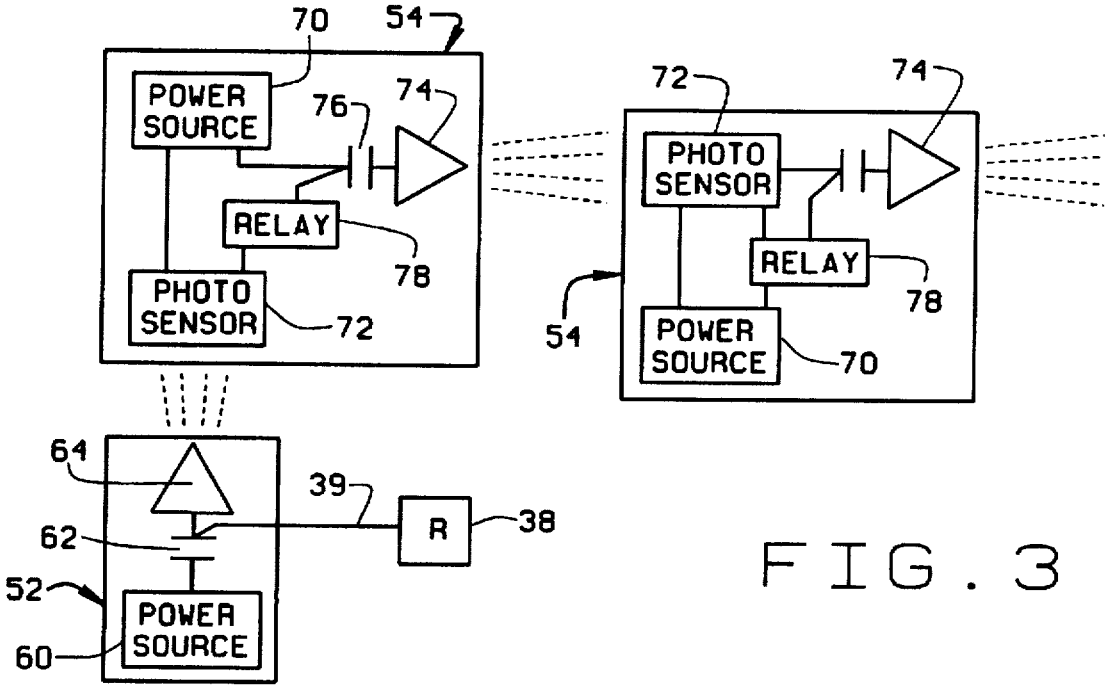
FIG. 3 is a block diagram of a primary strobe and two relay strobes.

FIG. 3 illustrates in greater detail the primary strobe 52 and the relay strobes 54. The primary strobe 52 includes a power source 60 connected to an illuminator 64 through a normally open relay contact 62. The relay contact 62, which is preferably a transistor, is controlled by the control signal 39 of the master receiver 38, and is held closed when the control signal 39 is asserted, thereby energizing the illuminator 64 with the power source 60. When the control signal 39 is deasserted, the relay contact 62 will return to its normally open state after approximately ten to thirty seconds as discussed below, thereby deenergizing the illuminator 64. Each relay strobe 54 includes a power source 70 connected to a photoelectric sensor 72 and also connected to an illuminator 74 through a normally open relay contact 76. The relay contact 76 is preferably a transistor, and another relay 78 is connected between the photoelectric sensor 72 and the base terminal of relay contact (transistor) 76 to regulate the amount of current applied to the base terminal by the photoelectric sensor 72 when energizing the illuminator 74.

Figure 4:
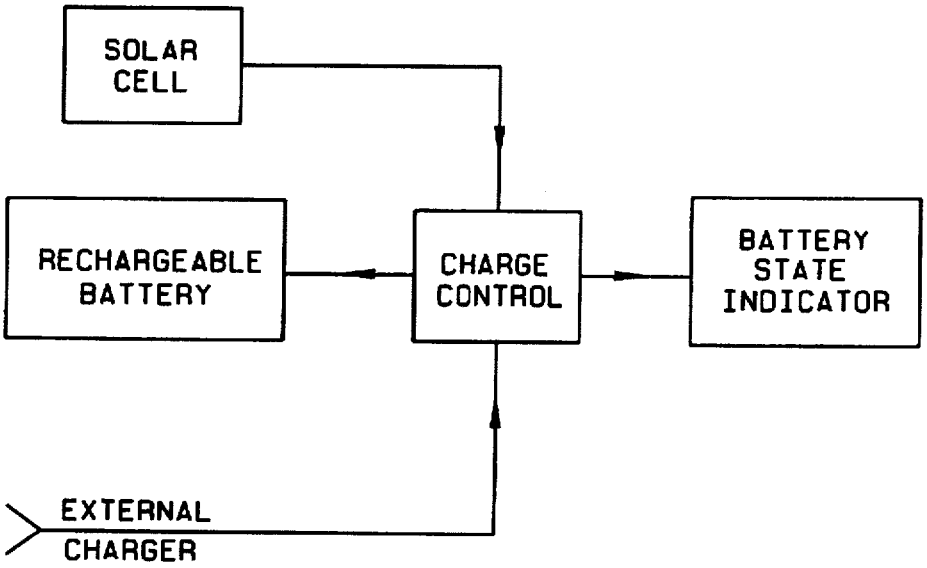
FIG. 4 is a block diagram of a battery charging and monitoring system for the strobes, transmitters, and receivers.

The power sources 60 and 70 are illustrated generally in FIG. 4, and preferably include six or twelve volt rechargeable batteries having solar cells associated therewith for replenishing the batteries, as well as having an additional recharging capability from an external charger such as a vehicle or equipment battery and/or AC power adaptor. Although shown only with the primary and relay strobes in FIG. 3, the battery system shown in FIG. 4 can also be used to power a transmitter and/or receiver of the intrusion detector array 32, either instead of or in addition to powering a primary or relay strobe.

The illuminators 64 and 74 are of the type commonly used in xenon strobe lights, and include clear lenses so that the emitted optical warning signal is white light. A white optical warning signal is preferred because other colors such as red, blue, and amber are commonly associated with emergency vehicles, and could therefore mislead work zone personnel, at least initially during critical moments, as to the type of hazard that is present.

When energized, the illuminator 64 of the primary strobe 52 emits an optical warning signal at a flash rate of 21.973 Hz and an optical intensity of approximately 1200 candela effective. The photoelectric sensor 72 of each relay strobe 54 is configured to detect infrared components of an optical warning signal having a flash rate of 21.973 Hz, regardless of whether the source of the optical warning signal is the primary strobe or another relay strobe. Upon detecting this optical warning signal, the illuminator 74 of each relay strobe 54 is energized to emit a substantially identical optical warning signal having a flash rate of 21.973 Hz and an optical intensity of approximately 1200 candela effective.

The preferred flash rate of the optical warning signal emitted by the primary strobe and the relay strobes is 21.973 Hz for several reasons. First, the inventor hereof has determined that flash rates between fifteen and thirty flashes per second have an optimal visual impact on work zone personnel, and are deemed "psychologically proactive." This means that the flash rate immediately creates anxiety in the unconscious mind, and is therefore more readily perceived than slower flash rates. These higher flash rates are also readily distinguishable from slower flashing or rotating lights present in a work zone. The inventor has also determined that by configuring the relay strobes to detect the infrared components of an optical warning signal having a flash rate of 21.973 Hz, the relay strobes are virtually immune to falsing by both natural and man-made light sources. While a vast number of light sources can be present within the vicinity of a work zone, including sunlight, lightning, aircraft beacons, and other types of warning lights, none of these light sources have a flash rate of 21.973 Hz. This is therefore an ideal flash rate for the primary and relay strobes, because if a relay strobe detects an infrared signal having this frequency, it is a near certainty that the infrared signal originated from the primary strobe 52 or another relay strobe 54. Hence, the relay strobes are not subject to falsing. As further protection against falsing, each photoelectric sensor 72 has a flash recognition setting such that the illuminator 74 is energized only after the photoelectric sensor detects six or more flashes from the primary strobe or another relay strobe.

As stated above, the intensity of the optical warning signal emitted by the primary and relay strobes is approximately 1200 candela effective. This light intensity enables work zone personnel to perceive reflections of the optical warning signal off of the roadway or nearby objects, even during broad daylight. As a result, work zone personnel need not look directly at one of the primary or relay strobes in order to perceive the optical warning signal, but can instead focus on their work assignments with the assurance that they will immediately perceive a reflection of the optical warning signal when emitted by a nearby strobe. Although even greater optical intensities are desirable, an intensity of 1200 candela effective can be readily achieved with commercially available xenon strobe lights, even when the strobe lights are powered by six or twelve volt rechargeable batteries.

The primary and relay strobes include timing circuits (not shown) so that when energized, the strobes will flash ten times, and then rest for an equivalent amount of time, so as to conserve battery power while maintaining an effective visual impact and photosensor detection capability. Once the control signal 39 from the master receiver 38 is deasserted, the primary strobe is deenergized which, in turn, deenergizes the relay strobes as the optical warning signal which activated the relay strobes will no longer be detected by the photoelectric sensors 72.

In the parent hereto, U.S. Pat. No. 5,552,767, the intrusion detector array 32 utilized a microwave signal for detecting an intrusion along a perimeter of the work zone. While this remains one preferred embodiment of the present invention, and represented a significant improvement over the prior art at the time of its development, the inventor hereof has subsequently designed and developed a new intrusion detector array which is easier to set up and which does not require FCC approval. The improved detector array employs a standard transmitter which emits a pulsed infrared light signal, and which can be used either as the master transmitter 36 or as one of the intermediate transmitters 42 and 48 depicted in FIG. 2. The improved detector array also employs a standard receiver which can detect the pulsed infrared light signal emitted by the standard transmitter, and which can be used either as the master receiver 38 or as one of the intermediate receivers 41 and 47 depicted in FIG. 2.

Figure 5:
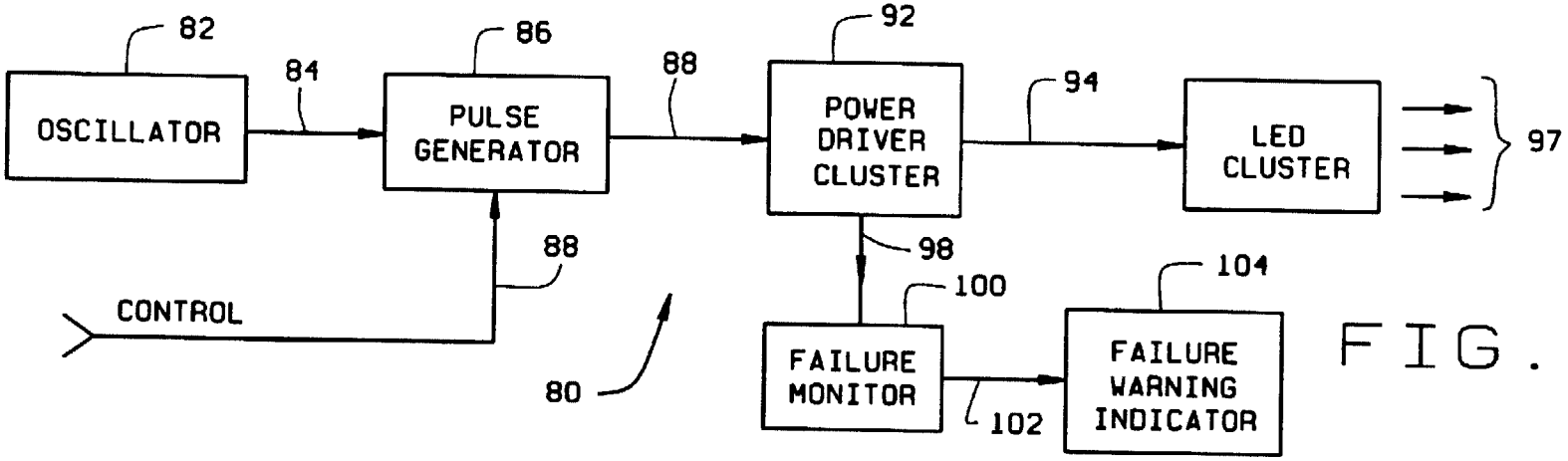
FIG. 5 is a block diagram of an infrared transmitter for the intrusion detector array of the present invention.

The standard transmitter of the improved detector array 32 is indicated generally as 80 in FIG. 5 and includes an oscillator 82 having an output 84 connected to a pulse generator 86 for supplying a square wave thereto. In the preferred embodiment, the oscillator is a crystal oscillator so that the frequency of the generated square wave remains constant despite fluctuations in the operating temperature of the standard transmitter 80. Alternatively, a standard timer can be employed, such as a NE555 timer commercially available from National Semiconductor.

The pulse generator 86 includes a gated input 88. Where the standard transmitter 80 is used as the master transmitter 36, the gated input 88 of the pulse generator 86 is set so that the master transmitter 36 continuously emits the intrusion detection signal 37 shown in FIG. 2. Alternatively, if the standard transmitter 80 is used as one of the intermediate transmitters 42 or 48, the gated input 88 of the pulse generator 86 is connected to a control signal output by the standard receiver (shown in FIG. 2 as control signals 44 and 50). The pulse generator 86 can be a monostable multivibrator, a NE555 timer, or a resistor-capacitor tank circuit as apparent to those skilled in the art.

The pulse generator 86 provides a pulsed output 88 to a cluster of power drivers 92 that, in turn, provide a driving signal 94 to a cluster of infrared emitting diodes 96. The diode cluster 96 emits the pulsed infrared detection signal 97 and, although not shown, may include one or more lenses for collimating the pulsed infrared signal 97. The driver cluster 92 includes at least two power drivers and the diode cluster 96 includes at least two infrared emitting diodes. Multiple drivers and diodes are employed in the standard transmitter 80 for at least two reasons. First, employing multiple diodes increases the power, and hence the detectable range, of the pulsed infrared signal 97, and can yield an infrared signal having a wider cross-sectional area at the downstream receiver to facilitate alignment of the downstream receiver with the standard transmitter 80. Second, by using multiple diodes and drivers, the operability of the standard transmitter 80 is maintained even when one of the drivers or diodes fails, although such an occurrence will typically reduce the detectable range of the pulsed infrared signal 97. However, a single driver and/or diode can be employed where desired.

The driver cluster 92 also includes an output 98 provided to a failure monitor 100. The output 98 represents the amount of power consumed by the driver cluster 92. Thus, if a power driver fails, or if an infrared emitting diode fails, the amount of power consumed by the power driver cluster 92 will decrease, and this decrease in power consumption will be detected by the failure monitor 100. As a result, a failure signal 102 will be provided to a warning indicator 104. An indication is thus provided when the range of the pulsed infrared signal 97 decreases, or when the pulsed infrared signal 97 is no longer generated, due to a failed driver or diode.

A significant source of noise in roadway work zones is the electromagnetic energy produced by the ignition systems of passing vehicles, and this noise generally occurs between two and four kilohertz. As described below, the electronics employed in the standard receivers 110 include suitable filters for preventing interference by this electromagnetic noise. For this reason, the frequency of the square wave generated by the oscillator 82 must be greater than the cut-off frequency of these filters. The frequency of the generated square wave is therefore at least ten kilohertz and, in the preferred embodiment, is approximately five hundred kilohertz so that suitable filters can be used in the receivers to remove low frequency noise while, at the same time, the frequency of the pulsed infrared signal 97 remains below popular communication frequencies which also need to be filtered. The pulse width of the signal output by the pulse generator 86, and hence the pulse width of the detection signal 97, is set as short as possible to conserve battery power while maintaining an acceptable detection range.

Under ideal conditions, the pulsed infrared signal 97 would be non-diverging as it travels away from the standard transmitter, and would be fully received by the standard receiver so as to maximize its detectable range. Due to real world conditions, however, the pulsed infrared signal continues to diverge slightly as it travels away from the standard transmitter 80. By the time the signal reaches a standard receiver positioned preferably 1000 to 1500 feet away from the standard transmitter, its cross-sectional area is greater than the diameter of the optical lens employed in the front end of the standard receiver. The detectable range of the pulsed infrared signal is therefore not maximized in the preferred embodiment, as not all of the energy contained within the signal impinges on the standard receiver. Nevertheless, the detectable range is substantially greater than the continuous wave detector of the prior art that cannot filter low frequency noise without also filtering out the signal to be detected. The net result is a pulsed infrared signal having an improved detectable range over the constant infrared detection beams of the prior art, and a large cross-sectional area where it impinges on the standard receiver so as to provide increased latitude in the standard receiver's alignment position. In other words, the width of the pulsed infrared signal makes it substantially easier to position the standard receiver within the line of sight of the standard transmitter, thereby contributing to the portability of the intrusion detector array.

Figure 6:
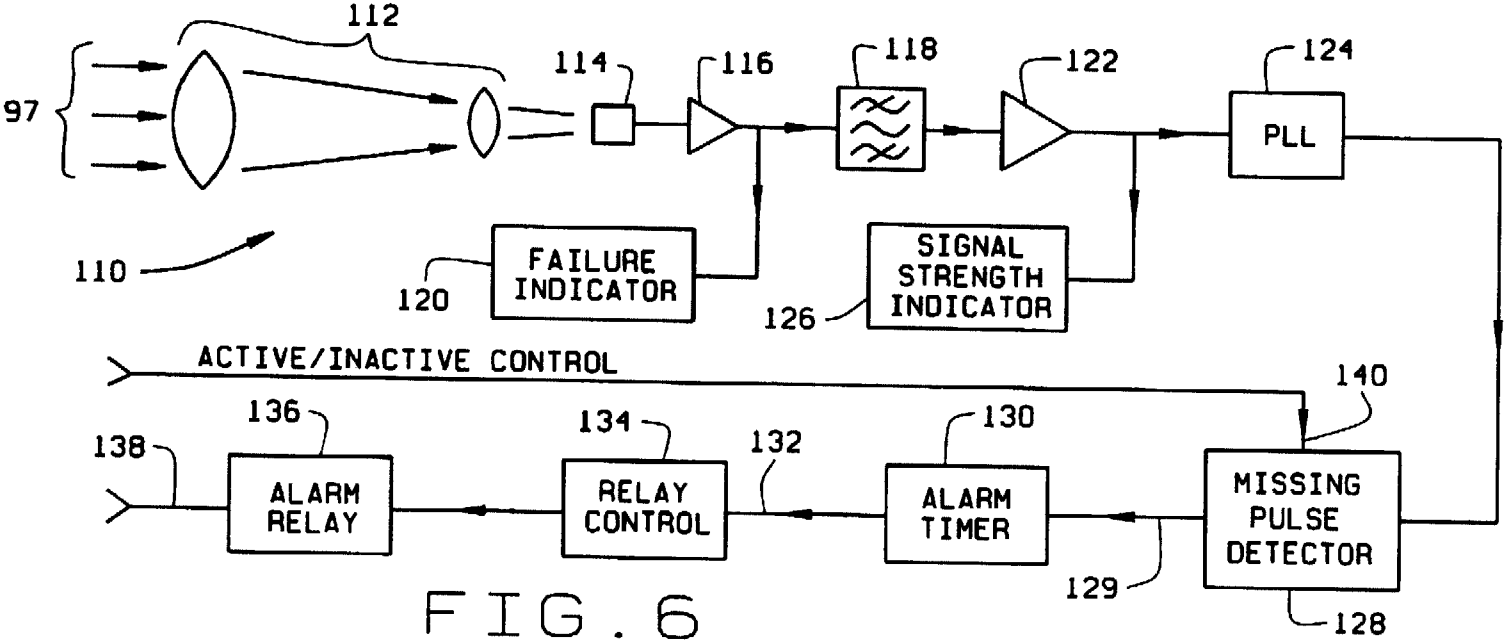
FIG. 6 is a block diagram of an infrared receiver for the intrusion detector array of the present invention.

FIG. 6 illustrates the standard receiver 110 which includes optics 112 for focusing received portions of the pulsed infrared signal 97 (as well as received but unwanted light signals) onto a photodiode 114. The optics 112 preferably include two or more lenses for focusing the pulsed infrared signal 97 onto the photodiode 114 so as to minimize the distance between the first lens, positioned at the front end of the standard receiver, and the photodiode 114. The output of the photodiode 114 is connected to a preamplifier 116 for amplifying the photodiode output before supplying this signal to a bandpass filter 118. The bandpass filter 118 has a center frequency of approximately five hundred kilohertz, which corresponds to the frequency of the oscillator 82 of the standard transmitter 80, and hence the frequency of the pulsed infrared signal 97. The bandpass filter thus removes contributions from unwanted signals above and below five hundred kilohertz, including signals emitted by vehicle ignition systems, 60 and 120 cycle sources, and communication devices.

The output of the preamplifier 116 is also supplied to a failure indicator 120. If there is no output from the preamplifier 116 because the photodiode 114 or the preamplifier 116 has failed, the failure indicator 120 will provide an indication of this condition. Conversely, if the optics 112 of the standard receiver 110 are focused on the sun, or on some other substantial light source, thereby significantly inhibiting the standard receiver's ability to detect the pulsed infrared signal 97, the failure indicator 120 will provide an indication to this effect as well.

The output of the bandpass filter 118 is supplied to a main amplifier 122 (which may include an AGC circuit as apparent to those skilled in the art) for gaining the filtered signal, and the output of the main amplifier 122 is provided to a phase locked loop (PLL) circuit 124, as well as to a signal strength indicator 126. The signal strength indicator 126 is preferably a fully integrated, ten-segment bar graph display for providing a visual indication of the strength of the pulsed infrared signal 97 received by the standard receiver 110, which can be used when aligning the standard receiver with an upstream transmitter, where a greater number of illuminated bars indicates a greater signal strength. Although the standard transmitter and/or receiver may optionally be provided with sighting scopes to facilitate easy target acquisition at extended distances, the signal strength indicator 126 simplifies fine tuning of the receiver position so as to maximize the detectable range of the pulsed infrared signal 97.

The PLL circuit 124, which locks onto the five hundred kilohertz pulsed infrared signal 97, provides an output to a missing pulse detector 128. The missing pulse detector 128 is preferably a retriggerable monostable multivibrator having a period set such that if a lock signal is continuously received from the PLL circuit 124, the output 129 of the missing pulse detector 128 will remain asserted. As will be apparent, the primary strobe 52 of the high intensity strobe light array 34 is activated when the output 129 of the missing pulse detector 128 is deasserted. Because the period of the pulsed infrared signal 97 received from the standard transmitter is approximately two microseconds in the preferred embodiment, if the period of the missing pulse detector 128 is set at two microseconds, and the missing pulse detector 128 continuously receives the lock signal from the PLL circuit 124, the output 129 of the missing pulse detector 128 will remain asserted, and the primary strobe will not be activated. However, it is highly possible, if not probable, that the pulsed infrared signal 97 will be occasionally obstructed by a bird, a drifting or falling leaf, or some other debris such that the missing pulse detector 128 will not continuously receive the lock signal. For this reason, the period of the missing pulse detector is set so as to prevent falsing by these insignificant occurrences. In the preferred embodiment, the period of the missing pulse detector is approximately one-tenth of a second. Thus, only when an object such as a vehicle prevents reception of the pulsed infrared signal 97 for more than one-tenth of a second will the output of the missing pulse detector 128 be deasserted, thereby activating the primary strobe 52 as explained immediately below.

The output 129 of the missing pulse detector 128 is provided to an alarm timer 130, which is also a monostable multivibrator, but having a negative trigger. When the missing pulse detector 128 fails to receive the lock signal for more than approximately one-tenth of a second, and its output 129 is deasserted, the alarm timer 130 will be triggered, and its output 132 will become asserted to activate the primary strobe via a relay control device 134 (such as a transistor) and an alarm relay 136. Where the standard receiver 110 is used as the master receiver, the output 138 of the alarm relay 136 corresponds to the control signal 39 depicted in FIGS. 2 and 3. Where the standard receiver 110 is used as an intermediate receiver, the output 138 of the alarm relay 136 corresponds to the control signal applied to the gated input 88 of the pulse generator 86 in an intermediate transmitter. The period of the alarm timer 130 is preferably ten seconds, so the primary strobe is either directly activated by the alarm relay, or indirectly activated by a disabled intermediate transmitter, for at least ten seconds anytime the pulsed infrared signal 97 is interrupted for more than a negligible period of time. This is more than enough time to warn work zone personnel of an errant vehicle, while preventing the strobes from unnecessarily depleting battery power.

The missing pulse detector 128 is also provided with an active/inactive control input 140 which can be used to prevent the output 129 from becoming deasserted, which would trigger the alarm timer 130 and activate the strobes. The active/inactive control input 140 can be used for testing or alignment of the system without activating the strobes and unnecessarily depleting battery power, and can also be used to allow a construction vehicle, for example, to enter the work zone without activating the strobes.

Employing a transmitter which outputs a pulsed infrared light signal, rather than a constant beam, provides a number of advantages, including an increased range over prior art transmitters. The pulsed infrared signal 97 of the preferred embodiment has a detectable range of approximately 1500 feet, which is twice as great as the continuous infrared detection beams of the prior art. This increase in the detectable range of the intrusion detection signal significantly reduces, or eliminates altogether, the number of intermediate receiver-transmitter pairs needed to repeat the intrusion detection signal along the full length of the work zone perimeter.

Furthermore, by utilizing a pulsed infrared light signal as an intrusion detection signal, the infrared receiver can include filters to remove stray signals having frequencies both less and greater than the pulsed infrared signal 97. These unwanted signals can be present in the work zone from sources such as the sun, artificial lights, and high temperature equipment, as well as the other sources mentioned above. If not filtered out by the receiver, the unwanted signals could be mistakenly interpreted to be the pulsed infrared signal 97, even when the signal 97 is not transmitted or when its reception is obstructed, thereby allowing a vehicle to enter the work zone undetected. By filtering out the stray signals, any likelihood that the receiver will fail to detect the absence of the pulsed infrared signal 97 is substantially eliminated, while the overall integrity of the intrusion detector array is significantly improved.

Figure 7:
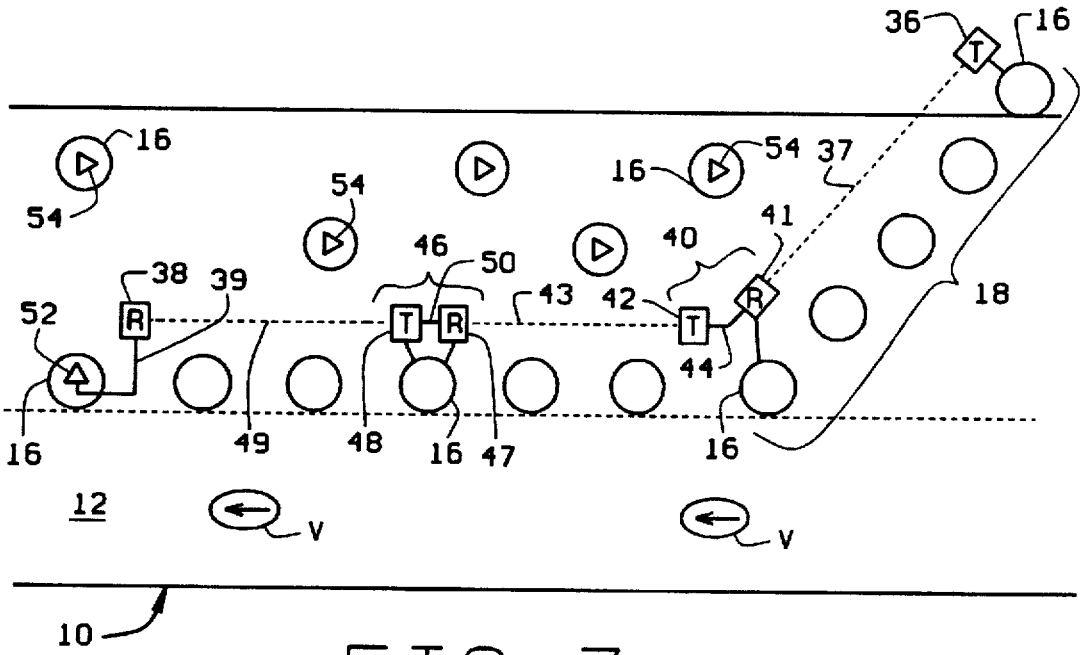
FIG. 7 is a top view of the assembly of FIG. 2 positioned within the work zone environment of FIG. 1.

FIG. 7 illustrates the assembly 30 of FIG. 2 positioned within the work zone environment illustrated in FIG. 1. The transmitters and receivers of the intrusion detector array 32 are preferably enclosed within waterproof housings, and are mounted to the sides of the channelizers 16 with adjustable brackets. As shown in FIG. 7, the master transmitter 36 is positioned so as to emit the intrusion detection signal 37 along the taper 18. The intermediate receiver-transmitter pairs 40 and 46 are positioned to emit intrusion detection signals 43 and 49, which are preferably identical to the intrusion detection signal 37, along the work zone perimeter adjacent to the active traffic lane 12. Although the intrusion detector array is shown positioned only along the work zone perimeter adjacent to the active traffic lane, it should be understood that the detector array can be positioned so as to completely enclose all sides of the work zone, where desirable, such as where active traffic lanes are present on both sides of the work zone.

The primary and relay strobes 52 and 54 are mounted atop channelizers 16, preferably at a height of approximately fifty inches, which is just below eye level for the average worker. To minimize feedback, the relay strobes 54 are preferably positioned so that the photoelectric sensors 72 only detect an optical warning signal that originates downstream. During testing, the primary strobe of the present invention was capable of activating a relay strobe positioned approximately 2,600 feet from the primary strobe. However, the relay strobes are preferably positioned between 500 and 1,500 feet from the primary strobe or another relay strobe, or closer, to ensure reliable operation under all weather and other environmental conditions. Although the relay strobes 54 are shown equally spaced in FIG. 7, the relay strobes are highly portable to accommodate positioning anywhere within or around the work zone. Personnel required to stand behind obstacles may place a relay strobe in close proximity to ensure immediate recognition of the optical warning signal. Likewise, an equipment operator required to look downward a high percentage of the time may place a relay strobe in close proximity to ensure the operator will immediately perceive reflections of the psychologically proactive optical warning signal emitted by the relay strobe.

In operation, if an object such as a vehicle passes between the master transmitter 36 and the receiver 41, thereby preventing the receiver 41 from detecting the intrusion detection signal 37, the control signal 44 output by the receiver 41 will be deasserted. As a result, a chain reaction is started whereby the transmitters 42 and 48 are disabled so that the master receiver 38 will no longer receive the intrusion detection signal 49. When this occurs, the control signal 39 output by the master receiver 38 will be asserted, thereby activating the primary strobe 52 which, in turn, will activate one or more relay strobes which can themselves further activate additional relay strobes. Thus, a cascading strobe effect is initiated by the perimeter breaching vehicle so as to saturate the work zone 14 with a high intensity, psychologically proactive optical warning signal that unmistakably and immediately indicates the presence of the errant vehicle.

This cascading strobe effect is similarly initiated by a vehicle which passes through the intrusion detection signal 43 or 49, or which collides with a channelizer 16 having one of the intermediate pairs 40 or 46 secured thereto. In this manner, the assembly of the present invention provides a highly portable and reliable detection and warning system that can detect an errant vehicle along any portion of the work zone perimeter, and which can provide an optical warning signal to work zone personnel that is capable of immediate perception despite the high level of noise and distractions present within the work zone. The work zone personnel are thus provided with a potentially lifesaving evacuation signal so the personnel can evacuate the work zone or otherwise evade the dangerously approaching vehicle.

Figure 8:
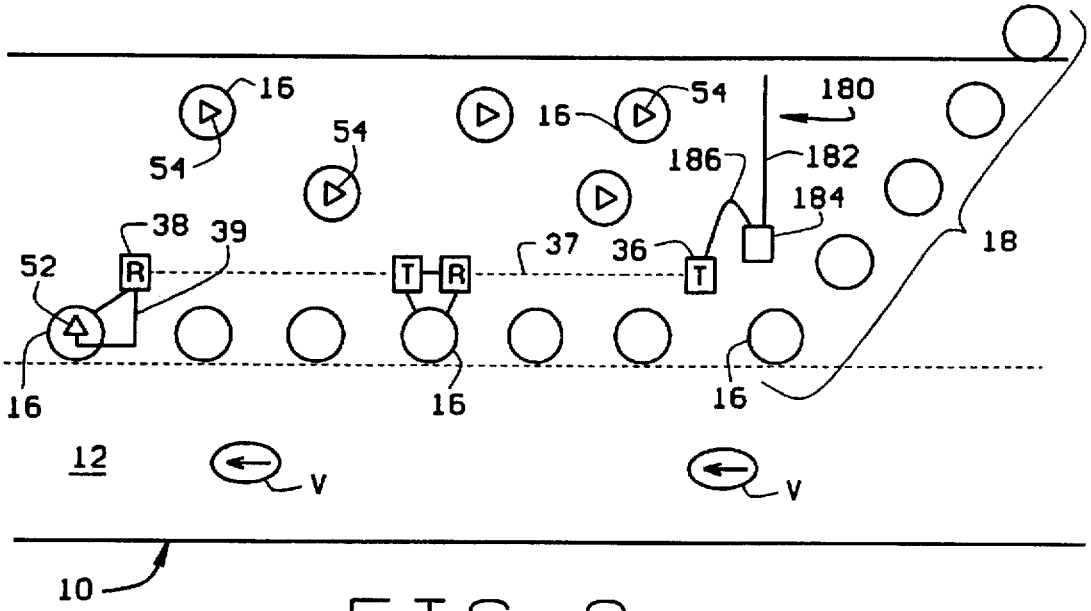
FIG. 8 is a top view of an alternative assembly that employs a pneumatic hose in the intrusion detector array.

FIG. 8 illustrates an alternative embodiment for the assembly depicted in FIG. 7 where the intermediate pair 40 is replaced by a pneumatic hose assembly 180, and the master transmitter 36 is repositioned at the end of the taper 18. The pneumatic hose assembly 180 includes a pneumatic hose 182 and a control module 184 which outputs a control signal 186 to the master transmitter 36. If a vehicle travels through the taper 18 and compresses the pneumatic hose 182, the control module 184 will detect a change in air pressure within the pneumatic hose 182, and will deassert the control signal 186 which, in turn, disables the master transmitter 36 from emitting the intrusion detection signal 37. This initiates the cascading strobe effect in the same manner as described above for previous embodiments so as to saturate the work zone with a psychologically proactive optical warning signal.

Figure 9:
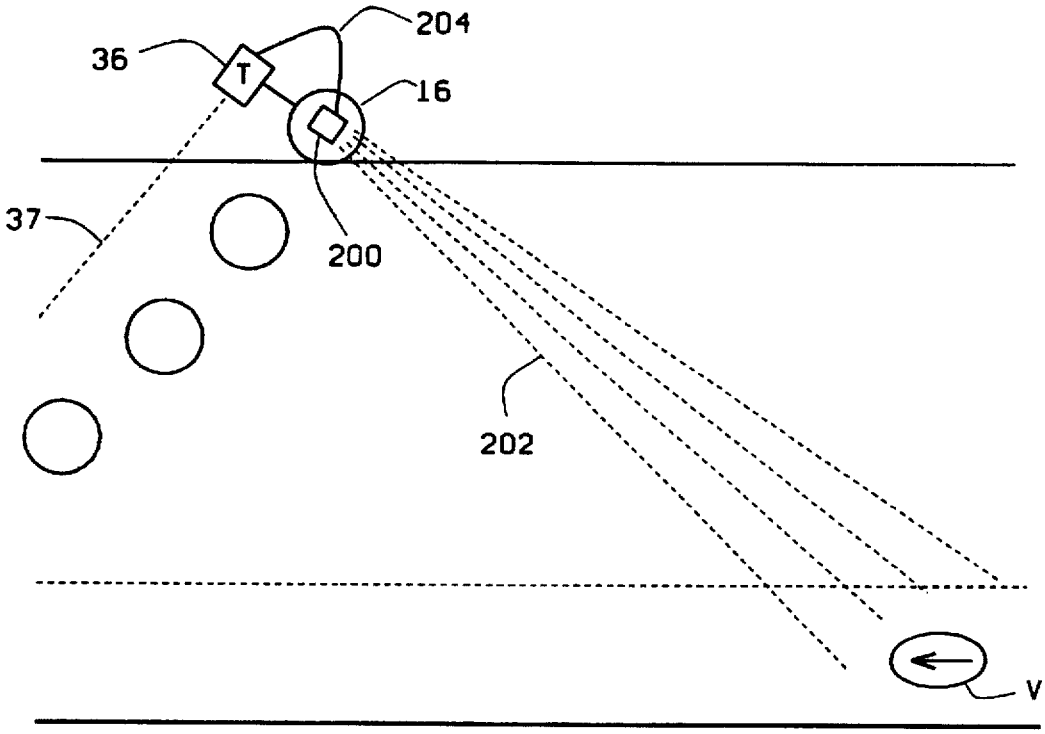
FIG. 9 is a partial top view of an alternative assembly that employs an electromagnetic emitter.

In still another embodiment of the present invention, an additional feature is provided to the assembly depicted in FIG. 7 for addressing the common problem of vehicles approaching the work zone while traveling at dangerously high speeds. Although most roadway work zones are accompanied by a temporary reduction in the speed limit, it is not uncommon for drivers to ignore the posted construction speed limit, as well as the posted pre-construction speed limit, and these speeding vehicles pose the greatest risk of injury or death to personnel within the work zone. The inventor hereof has recognized that the vast majority of these drivers possess onboard radar detectors for detecting the presence of police trap, and that these drivers readily reduce the speed of their vehicles when the presence of police radar is detected. Therefore, the assembly of FIG. 9 is illustrated as including an electromagnetic emitter 200 positioned at the beginning of the work zone on top of the channelizer 16 supporting the master transmitter 36. The electromagnetic emitter 200 radiates vehicles approaching the work zone 14 with electromagnetic energy 202 to thereby activate any radar detectors within the vehicles and falsely convey the presence of police radar. As a result, reckless drivers that travel at excessive speeds and that utilize a radar detector will be inclined to reduce the speed of their vehicles, thereby increasing a safety factor for personnel positioned within the work zone.

Where the assembly of the present invention will be used within a roadway work zone for an extended period of time, drivers possessing radar detectors which travel by the work zone on a regular basis are likely to recognize the work zone as the source of the radar emission, rather than a police radar trap, and may therefore learn to ignore the signal provided by their onboard radar detectors while continuing to travel at dangerously high speeds. To address this problem, the electromagnetic emitter 200 can be configured to randomly emit the electromagnetic energy 202 so as to prevent drivers from recognizing the work zone as the source of the electromagnetic energy. This technique is more fully articulated in commonly owned U.S. application Ser. No. 08/640,146 filed Apr. 30, 1996, the disclosure of which is incorporated herein by reference.

Alternatively, the electromagnetic emitter 200 can be configured to emit the electromagnetic energy 202 continuously. Although certain reckless drivers may recognize the work zone as the radar source, rather than a police radar trap, and may thus refuse to reduce the speed of their vehicles, a warning signal can instead be provided to the work zone personnel to notify the personnel of the dangerously speeding vehicle that has an increased probability of losing control or otherwise breaching the work zone perimeter. In this alternative embodiment, the electromagnetic emitter 200 is embodied within an excessive speed detector for determining whether a vehicle approaching the work zone is exceeding a preset speed threshold. For example, if the posted construction speed limit is 40 miles per hour, the threshold of the excessive speed detector 200 can be set at 65 miles per hour. If the speed detector 200 then detects a vehicle approaching the work zone at a speed greater than 65 miles per hour, an output signal 204 can be deasserted so as to disable the master transmitter 36 and initiate the cascading strobe effect within the work zone to warn personnel of the dangerously approaching vehicle.

The excessive speed detector 200 is preferably an X-band speed detector such as that commercially available from AGD Systems Limited of the United Kingdom, which includes a direction discrimination capability so as to distinguish vehicles that are approaching the detector (and thus the work zone) from vehicles which are traveling away from the detector. Where the roadway work zone is positioned along a highway, it is not uncommon for the taper 18 to have a length of approximately 800 feet. The commercially available excessive speed detector utilized in this embodiment has a detection range of approximately 100 to 300 feet, depending upon the size and shape of the approaching vehicle. Because work zone personnel will be positioned downstream from the end of the taper 18, the excessive speed detector will detect speeding vehicles at least 900 to 1,100 feet in advance of the end of the taper, thereby providing sufficient time to warn the personnel of the approaching vehicle. However, it should be understood that other positions for the excessive speed detector can be employed, and that other types of speed detectors can be utilized with similar effect, including those constructed with pneumatic hoses and suitable electronics. The excessive speed detector 200 can also be used without the intrusion detector array 32, and can be used with an alarm other than the high intensity strobe light array 34, where effective.

A method for decreasing accidents in a roadway work zone according to the present invention includes every implication of the set-up, alignment, and operation of the assembly described herein and all embodiments thereof. Although there are various changes and modifications which may be made to the invention as would be apparent to those skilled in the art, these changes or modifications are included in the teaching of the disclosure, and is intended that the invention be limited only by the scope of the claims appended hereto, and their equivalents.

What is claimed is:

1. An apparatus for alerting personnel within a roadway work zone when a vehicle approaching the roadway work zone is traveling at an excessive speed, the apparatus comprising:

a portable detector configured for determining whether a vehicle approaching the roadway work zone is exceeding a speed threshold; and a portable alarm communicating with the portable detector for providing a warning signal to the roadway work zone personnel when activated, the portable detector being configured for activating the portable alarm upon determining that a vehicle approaching the roadway work zone is exceeding the speed threshold.

2. The apparatus of claim 1 wherein the portable detector is configured for discriminating between a vehicle approaching the portable detector and a vehicle travelling away from the portable detector.

3. The apparatus of claim 2 wherein the portable alarm comprises an optical signalling device for visually warning the roadway work zone personnel.

4. The apparatus of claim 3 wherein the optical signalling device comprises a high intensity primary strobe for emitting an optical warning signal at a predetermined flash rate.

5. The apparatus of claim 4 wherein the optical signalling device further comprises at least one high intensity relay strobe separate from the primary strobe for emitting an optical warning signal when activated, the relay strobe being activatable by the optical warning signal emitted by the high intensity primary strobe at the predetermined flash rate.

6. A roadway work zone safety device comprising:

a portable detector for detecting errant vehicles; and a portable optical alarm communicating with the portable detector and activated by the portable detector for emitting an optical warning signal when an errant vehicle is detected by the portable detector to thereby visually warn personnel within a roadway work zone of the errant vehicle, wherein the portable detector is configured for detecting when a vehicle approaching the roadway work zone is exceeding a speed threshold.

7. A roadway work zone safety device comprising:

a portable detector for detecting errant vehicles; and a portable optical alarm communicating with the portable detector, the portable optical alarm including a primary strobe that is activated by the portable detector for emitting an optical warning signal when an errant vehicle is detected by the portable detector to thereby visually warn personnel within a roadway work zone of the errant vehicle; and an electromagnetic emitter for radiating vehicles approaching the roadway work zone with electromagnetic energy to thereby activate radar detectors within the approaching vehicles.

8. The safety device of claim 7 wherein the electromagnetic emitter is configured for randomly radiating vehicles approaching the roadway work zone with electromagnetic energy.

9. A method for decreasing accidents in a roadway work zone, the method comprising the steps of:

detecting errant vehicles with a portable detector;

activating a portable optical alarm when an errant vehicle is detected to thereby visually warn personnel within the roadway work zone of the errant vehicle; and radiating vehicles approaching the roadway work zone with electromagnetic energy to thereby activate radar detectors within the approaching vehicles.

10. The method of claim 9 wherein the radiating step includes randomly radiating vehicles approaching the roadway work zone with electromagnetic energy.

11. The method of claim 9 wherein the roadway work zone is stationary.

12. A roadway work zone safety device comprising:

a portable detector for detecting errant vehicles, the portable detector including a master transmitter for emitting a pulsed infrared signal along a perimeter of the roadway work zone, a master receiver for receiving the pulsed infrared signal, and a pneumatic hose operatively connected to the master transmitter for disabling the master transmitter in response to the pneumatic hose being compressed, thereby causing an interruption in the pulsed infrared signal emitted by the master transmitter; and a portable optical alarm communicating with the portable detector, the portable optical alarm including a primary strobe that is activated by the portable detector for emitting an optical warning signal when an errant vehicle is detected by the portable detector to thereby visually warn personnel within a roadway work zone of the errant vehicle, the master receiver communicating with the primary strobe and activating the primary strobe in response to an interruption in the pulsed infrared signal received from the master transmitter.

* * * * *